United States Patent [19]

Lacks

[11] 4,011,040

[45] Mar. 8, 1977

[54] LIGHTER COVER

[76] Inventor: Harold G. Lacks, 2100 S. Ocean Lane, Apt. 2407, Fort Lauderdale, Fla. 33316

[22] Filed: Dec. 8, 1975

[21] Appl. No.: 638,699

[52] U.S. Cl. ..... 431/344

[51] Int. Cl.[2] ..... F23D 2/36

[58] Field of Search ..... 431/144, 146, 152, 344, 431/253

[56] References Cited

UNITED STATES PATENTS

| | | | |
|---|---|---|---|
| 2,352,897 | 7/1944 | Hickman | 431/144 |
| 2,774,234 | 12/1956 | Blaisdell et al. | 431/152 |
| 3,744,958 | 7/1973 | Cobarg | 431/344 X |

*Primary Examiner*—Edward G. Favors
*Attorney, Agent, or Firm*—Malin & Haley

[57] ABSTRACT

A lighter cover for a lighter having two end portions larger than a narrower central portion. The lighter cover including a main casing member and a secondary member connected inside said main cover member by hinge means positioned nearer one end of the lighter cover. The lighter cover operates in scissor fashion to encompass the lighter.

3 Claims, 8 Drawing Figures

LIGHTER COVER

BACKGROUND OF THE INVENTION

In the past lighters have had cylindrical or rectangular shaped bodies. The replaceable covers for permanent lighters or permanent covers for throw-away lighters have been constructed of the identical shape as the body of the lighter.

BRIEF DESCRIPTION OF THE INVENTION

The new and improved replaceable lighter cover for a lighter with a smaller perimeter, intermediate portion, spaced from the larger end portions includes a scissor body means. The scissor body means includes a main casing member and a secondary member. The main member and the secondary member are connected together by mating of the indented hinge portions of the main member to the hinge portions of the secondary member. A portion of the distal longitudinal outside edge portions of the secondary member engages the distal longitudinal inside edge portions of the main member when the lighter casing is in a closed position.

It is an object of this invention to provide a non-complex lighter cover that locks on the lighter.

It is another object of this invention to provide a non-complex easily manufactured lighter cover for the lighter shown in FIG. 7.

Another object of this invention is to provide a lighter casing that opens with scissor-like action, opening the top and narrowing the base for a lighter having two enlarged ends and a smaller intermediate portion that automatically closes the top of the lighter casing as it widens the base of the lighter casing when the lighter is slid into the top lighter casing and moved past the hinge means.

In accordance with these and other objects which will be apparent hereinafter, the instant invention will now be described with particular reference to the accompanying drawing.

DESCRIPTION OF AN EMBODIMENT OF THE INVENTION

Figure 1:
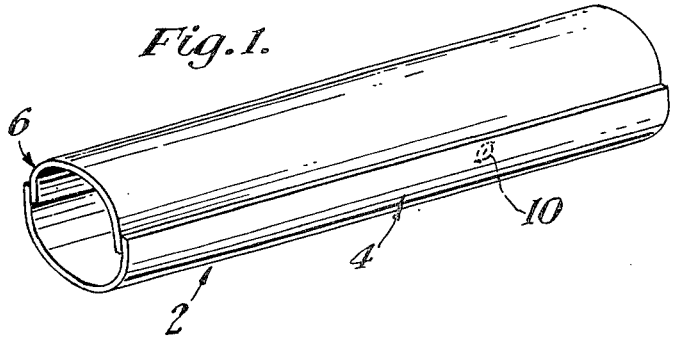
FIG. 1 is an isometric view of the lighter cover in a closed position.
Figure 2:
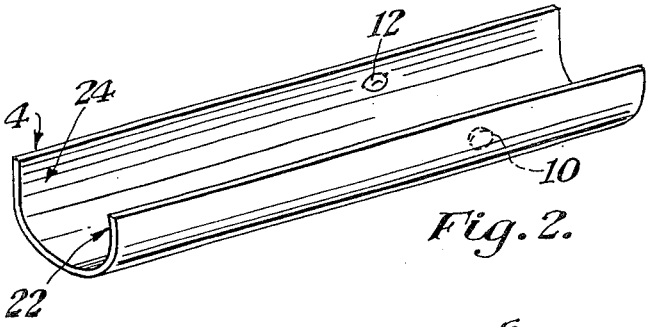
FIG. 2 is an isometric view of the main member, shown in FIG. 1.
Figure 5:
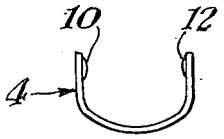
FIG. 5 is a bottom end view of the main cover member shown in FIG. 2.
Figure 3:
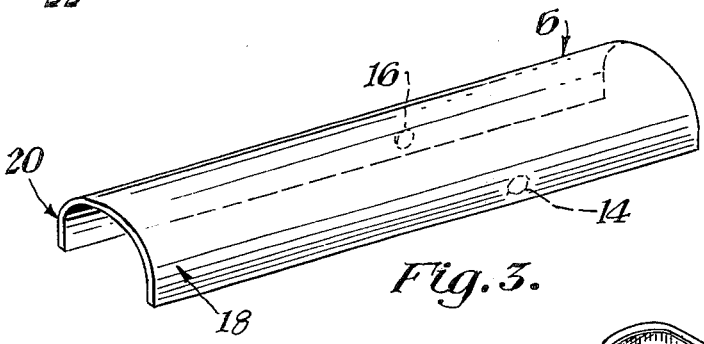
FIG. 3 is an isometric view of the secondary member shown in FIG. 1.
Figure 6:
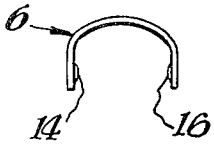
FIG. 6 is a bottom end view of the secondary member shown in FIG. 3.
Figure 7:
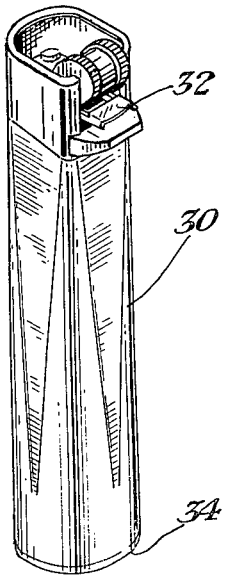
FIG. 7 is an isometric view of a lighter that the removable cover will fit.

Referring now to a new and improved replaceable lighter casing shown in FIGS. 1 through 6 and 8 for a lighter shown in FIG. 7 with a smaller perimeter intermediate portion 30 spaced from larger end portions 32 and 34. The base portion of the lighter is illustrated by number 34 and the top portion is illustrated by number 32. The replaceable lighter cover 2 includes a scissor body means. The scissor body means includes a main casing member 4 also shown in FIGS. 1, 2, 4 and 5 and a secondary member 6 shown in FIGS. 1, 3, 4 and 6. The main member 4 and the secondary member 6 are connected together by mating of the indented hinge portions 10 and 12 of the main member 4 to the indented hinge portions 14 and 16 of the secondary member 6. The hinge portions may be indented outwardly or as shown. A portion of the distal longitudinal outside edge portions 18 and 20 of the secondary member 6 as shown in FIG. 3, engages the distal longitudinal inside edge portions 22 and 24 of the main member 4 as shown in FIG. 2 when the lighter casing 4 is in a closed position, see FIGS. 1 and 4.

Figure 8:
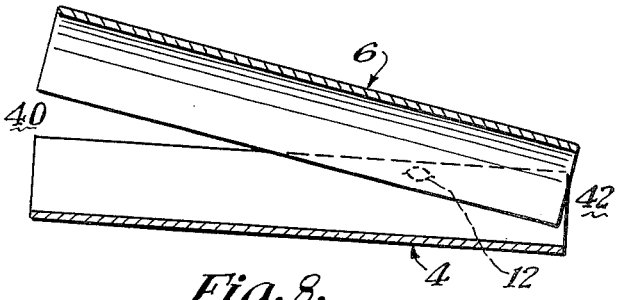
FIG. 8 is a cross section side view of the lighter cover in an open position.

The removable lighter cover shown in FIG. 1 for a lighter shown in FIG. 7 includes a main member 4 and a secondary member 6 connected to said main casing member by hinge means 10, 12, 14 and 16 positioned approximately ⅓ plus or minus 1/6 of the total distance from the base end of the lighter cover, the right end in FIG. 1. To place the cover on the lighter, the top end, the left side of FIG. 1, of the lighter cover is opened as shown in FIG. 8 and the bottom end is narrowed by scissor-like movement of the members about the hinge means. After the lighter is inserted into said top end and moved past the hinge mean, the sides of the members adjacent the enlarged end are moved closer together. The top ends are moved closer together about the lighter as the base ends are moved further apart by the movement of the lighter end 34 from left to right in FIG. 8. When the lighter shown in FIG. 7 is inserted, end 34 first, into the open end, that is, the wide opening, as shown in FIG. 8, and moved to the right until the cover encloses the lighter.

Figure 4:
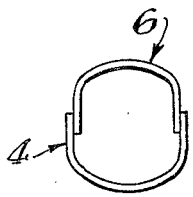
FIG. 4 is a bottom end view of the lighter cover shown in FIG. 1.

FIGS. 4, 5 and 6 shows end views of the cover and the overlapping sides.

The lighter cover material may be made of a thin metal material or other suitable material. The top portion of the main member or the secondary member may be matched to fit around the lighter lip 34.

In the closed position of the lighter cover or casing, the opening at the top end of said lighter casing is smaller than the opening in the lighter cover at the hinge means and smaller than the base of the lighter to lock the lighter in the lighter casing. The opening at the base end of said lighter cover is at least equal to the size of the base end of the lighter and the opening of the lighter cover at the hinge means is at least equal to the size of the base end of the lighter.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. In a lighter and lighter cover device with the lighter including a lighter body having two end portions larger than a narrower central portion, the improvement of which comprises:

a lighter cover including, a main member including a portion of a mating hinge means, and a secondary member including the other portion of a mating hinge means, said secondary member connected to said main member by the mating hinge portions to provide a scissor-like action to open one end to receive the lighter body and to close over the central portion after one end portion of the lighter body moves past the hinge means.

2. An improvement as set forth in claim 1 wherein, said main member and said secondary member having a top end that opens wider and a base end that narrows when said cover receives the lighter, and said hinge portions are positioned approximately one third of the total longitudinal length of the lighter cover from the said base end of said lighter cover.

3. An improvement as set forth in claim 1 wherein, in the closed position the opening at the top end of said lighter cover is smaller than the opening in the lighter cover at the hinge means, the opening at the base end of said lighter cover is at least equal to the size of the base end of the lighter, and the opening of said lighter cover at the hinge means is at least equal to the size of the base end of the lighter.

* * * * *